United States Patent [19]

Kelly

[11] Patent Number: 5,007,268

[45] Date of Patent: Apr. 16, 1991

[54] METHOD AND DEVICE FOR EDGE-FINISHING

[75] Inventor: Nigel B. Kelly, No. 1 Bellevue, Clifton, United Kingdom, BS8 1DA

[73] Assignees: Nigel Brian Kelly, Clifton; Originations Limited, Woodland Way, both of United Kingdom

[21] Appl. No.: 477,186

[22] Filed: Feb. 5, 1990

Related U.S. Application Data

[63] Continuation of Ser. No. 356,675, May 23, 1989, abandoned, which is a continuation of Ser. No. 209,478 filed as PCT GB 86/00777 on Dec. 18, 1986, published as WO87/03830 on Jul. 2, 1987, abandoned.

[51] Int. Cl.[5] ..... B25D 1/00

[52] U.S. Cl. ..... 72/76; 72/53; 72/476; 72/710; 29/81.15; 29/81.16; 29/81.17; 29/90.3; 51/57

[58] Field of Search ..... 29/81 L, 81 D, 90.3, 29/90.7, 81.15, 81.16, 81.17; 72/476, 53, 76, 710; 51/57, 59 R

[56] References Cited

U.S. PATENT DOCUMENTS

| | | | |
|---|---|---|---|
| 3,150,888 | 9/1964 | Parker | 29/81 D |
| 3,926,031 | 12/1975 | Neilsen | 173/123 |
| 3,937,055 | 2/1976 | Curuso et al. | 72/53 |
| 4,605,073 | 8/1986 | Nilsson et al. | 29/81 D |
| 4,641,510 | 2/1987 | Mitsching et al. | 72/53 |

*Primary Examiner*—David Jones

*Attorney, Agent, or Firm*—Merchant & Gould

[57] ABSTRACT

An edge-finishing device comprises a drive unit (L), a holder (M) and a notched tip (N). The tip combines a number of geometric features known as land radius (Y), flank faces (K), flank radii (I) and root radius (J). Typical useage of the device requires a tip to be fitted into the holder, the tip being then offered against the workpiece using the flank faces for guidance. The land radius determines the contact area. The tip impacts against the workpiece and bends the protrusions over. The flank radii then beat the protrusions thin enough for them to break off or be driven off. The tip continues to impact until the finished edge conforms to the root radius.

4 Claims, 5 Drawing Sheets

METHOD AND DEVICE FOR EDGE-FINISHING

This is a continuation of application Ser. No. 356,675, filed May 23, 1989, now abandoned, which is a continuation of Ser. No. 209,478, filed as PCT GB86/00777 on Dec. 18, 1986, published as WO87/03830 on Jul. 2, 1987, now abandoned.

The present invention relates to the finishing-off of edges on workpieces by the smoothing of existing edges by the removal of burrs, sharp edges, fettles or other protrusions through peening and/or breaking away of the unwanted material on the edge prior to forming a clean smooth edge.

BACKGROUND OF THE INVENTION

Edge finishing and deburring are operations that must be carried out on many objects after they have been machined, cut or otherwise formed. At present these operations are carried out by hand (by filing or scraping), by grinding, by chemical erosion methods or by some other means. None of these methods is considered to be totally satisfactory.

SUMMARY OF THE INVENTION

According to the present invention there is provided an edge-finishing device for finishing the edge of a workpiece comprising a tip for reciprocation against the edge, the tip having a notch with outer flank surfaces which serve to guide the tip initially onto the workpiece edge, the notch having inner flank surfaces which serve to beat a burr or protrusion thin enough to be broken or driven off from the edge and the base of the notch having a curved surface which, in use, determines the finish given to the edge of the workpiece.

The present invention further provides a method of finishing a workpiece edge, comprising reciprocating against the edge a tip of an edge-finishing device, the tip having a notch, the base of the notch having a curved surface which determines the edge finish and the notch having flank faces for guiding the tip onto the workpiece edge, the tip beating a burr or protrusion on the workpiece edge thin enough that it is broken or driven off the edge, the flank faces preferably each comprising an outer flank surface for guiding the tip onto the workpiece edge and an inner flank surface, at least one of the inner flank surfaces beating the burr or protrusion.

BRIEF DESCRIPTION OF THE DRAWINGS

Some embodiments of the invention are illustrated in the accompanying drawings, in which.

DESCRIPTION OF THE PREFERRED EMBODIMENT

Figure 5A:
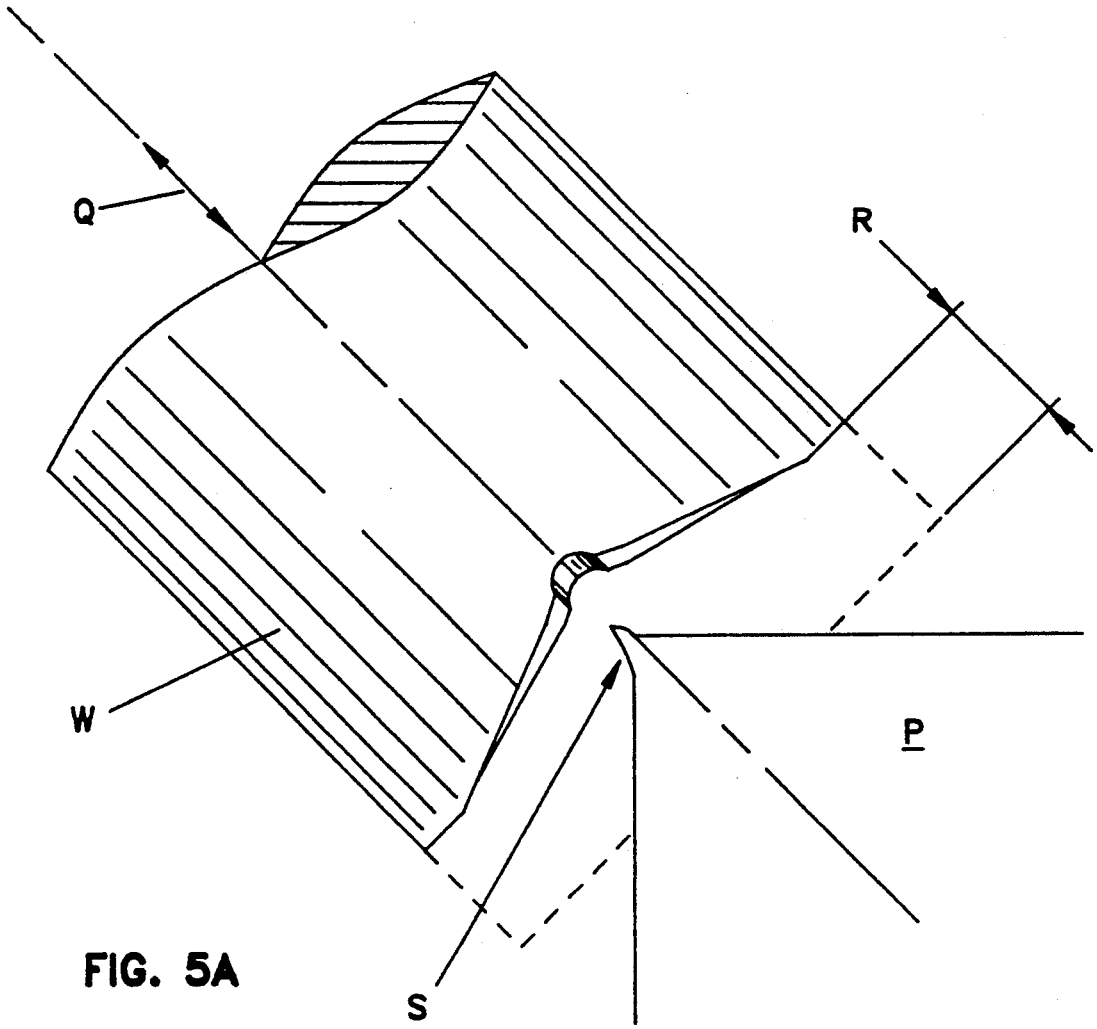
FIG. 5*a* illustrates operation of the device.
Figure 5B:
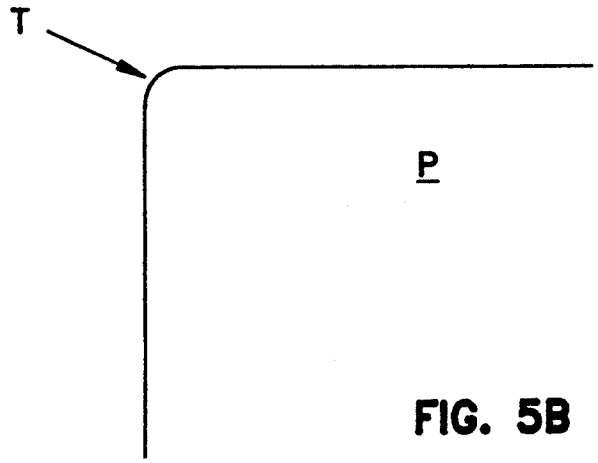
FIG. 5*b* shows a finished edge.

In one example of the invention there is provided a tip with a notch formed into its end. The notched end of the tip is impacted against a workpiece edge as shown in FIG. 5*a*. The reciprocating action is provided by a prime mover, usually an electrically or pneumatically powered drive.

Figure 4:
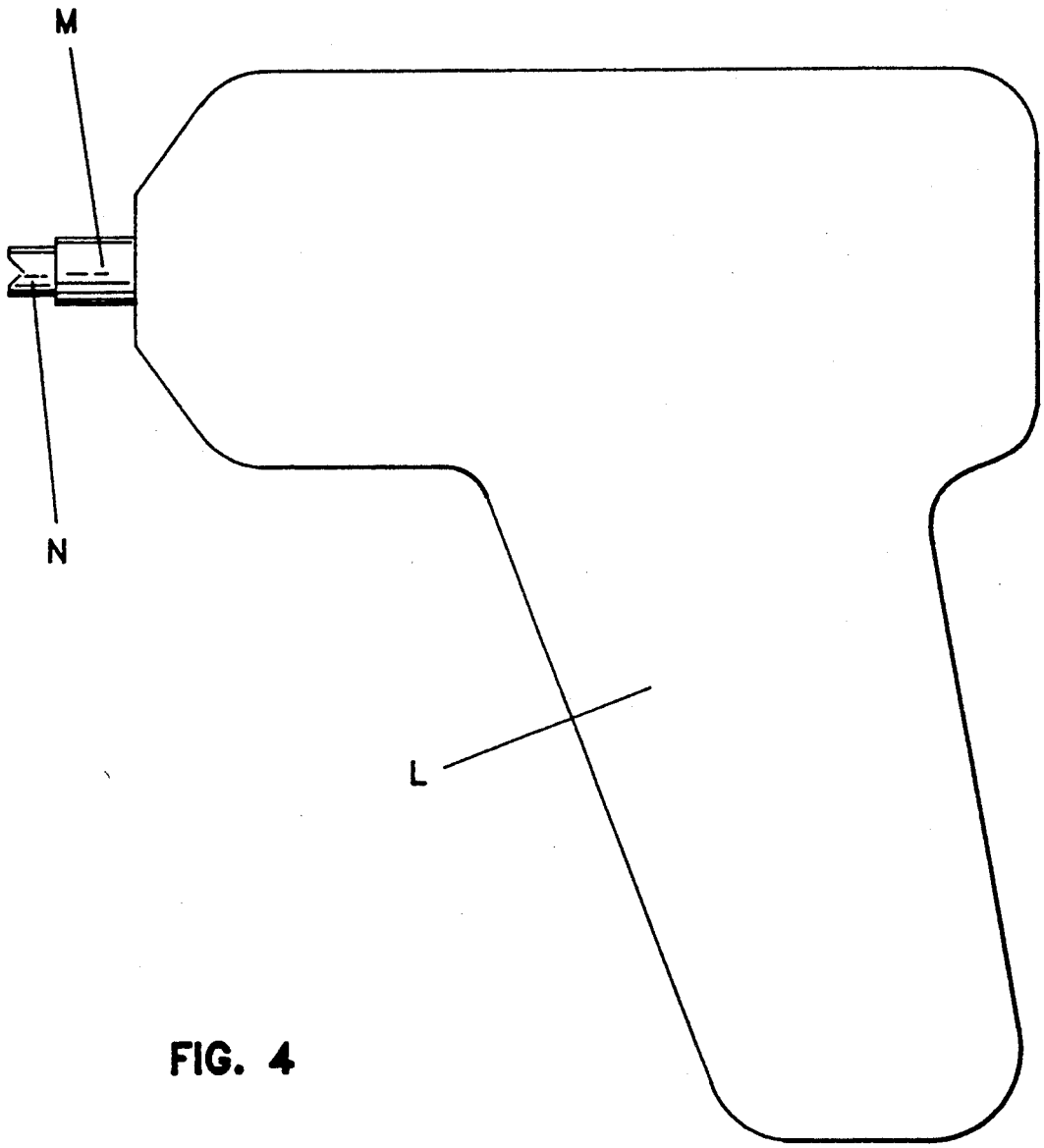
FIG. 4 shows one of the tips fitted in a holder.

A typical embodiment of the invention is shown in FIG. 4, whereby a tip N is held in a holder M and a reciprocating drive unit L provides the impacting action.

FIG. 1*a* to 1*d* show a tip having a root curve C at the base of a notch A formed by flank surfaces D.

FIGS. 2*a* to 2*d* show a tip N with a notch H formed by flank surfaces each having an outer flank surface K. A root curve J curves into inner flank surfaces I which lead in turn into the outer flank surfaces K.

The tip combines a number of important variables:

1. Land Surfaces

This provides for a contact area (land) onto the workpiece edge. Generally the harder the material to be finished the lesser the contact area or land required, and thus the lesser the land surface radius required. The land surface has a radius which would, typically, be 20 mm.

2. Flanks

The outer flank surfaces help to initially guide the tip on the workpiece edge. The outer flank surfaces K lead into the inner flank surfaces I, which bend or beat the protrusion or burr over the side of the workpiece until it is broken off. The inner flank surfaces have a radius which would, typically, be 1 mm.

3. Root curve

This is the curved surface J at the base of the notch that strikes the workpiece edge and determines the finish given.

The root curve J has a radius which would, typically, be 0.25 mm.

FIGS. 1*a* to 1*d* show an example of a tip. This tip has a root curve C at the base of the notch A formed by the flank surfaces D. In the case of this tip the flank surfaces are flat and the land B is a straight trough forming the contact area before tapering away outwards clearing the workpiece.

Figure 1A:
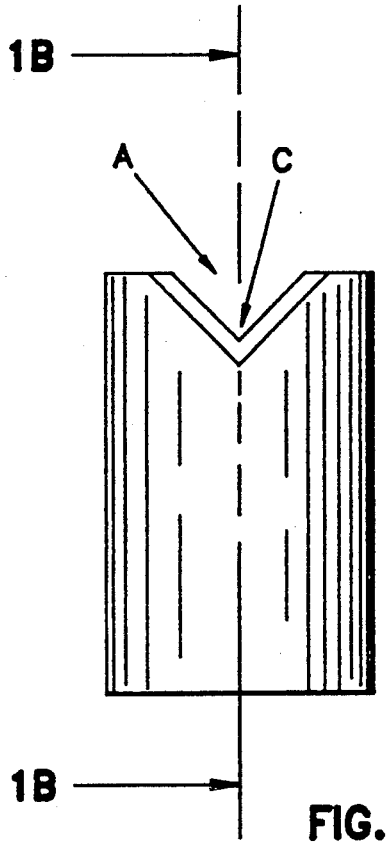
FIG. 1*a* shows a side view of a tip.
Figure 1B:
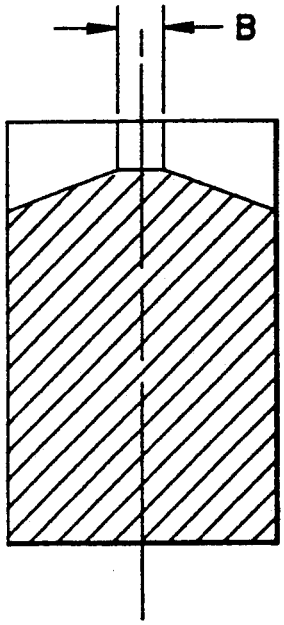
FIG. 1*b* shows a sectional view of the tip of FIG. 1*a*.
Figure 1C:
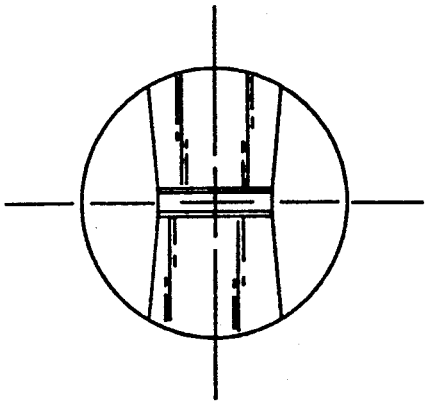
FIG. 1*c* shows the upper end of the tip of FIG. 1*a* in plan view.
Figure 1D:
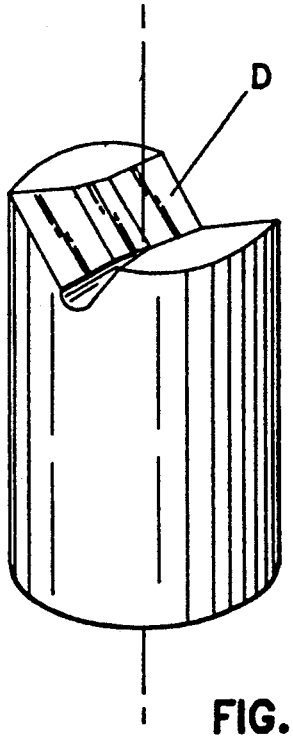
FIG. 1*d* shows a perspective view of the tip of FIG. 1*a*.
Figure 2A:
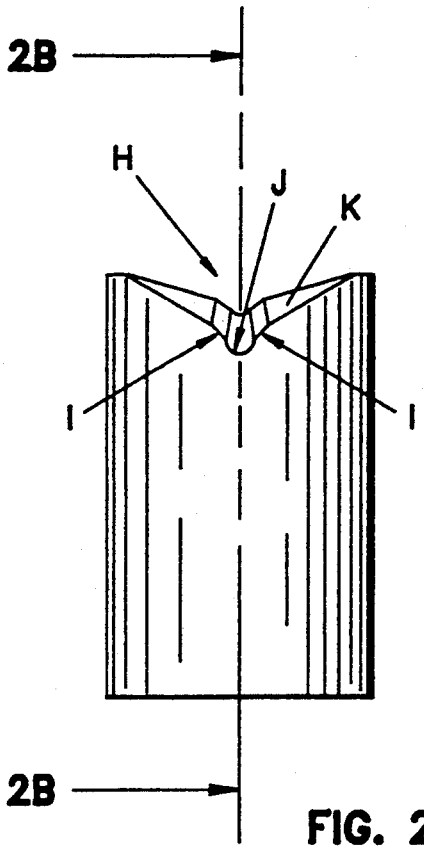
FIG. 2*a* shows another tip.
Figure 2B:
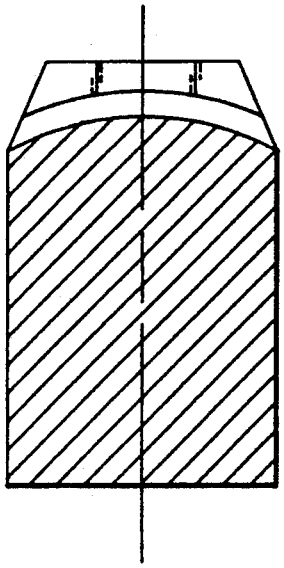
FIG. 2*b* shows a sectional view of the tip of FIG. 2*a*.
Figure 2C:
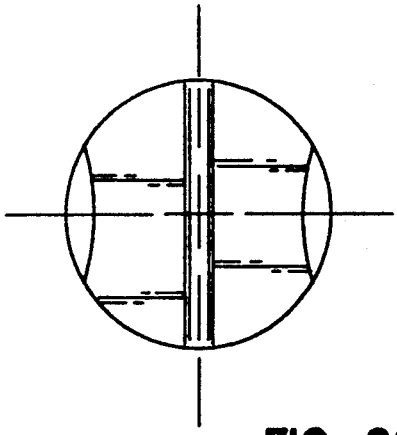
FIG. 2*c* shows the upper end of the tip of FIG. 2*a* in plan view.
Figure 2D:
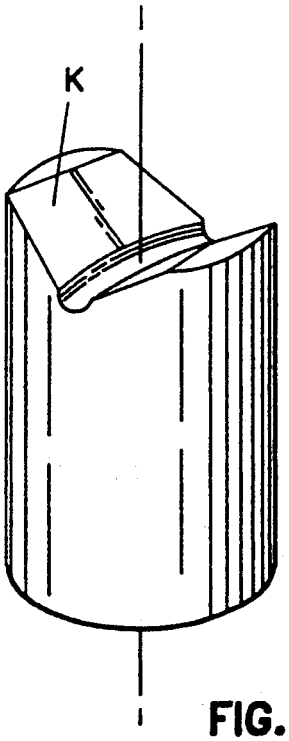
FIG. 2*d* shows perspective view of the tip of FIG. 2*a*.

FIGS. 2*a* and 2*d* show a tip with a notch H formed by the outer flank surfaces K. The root curve J merges into the inner flank surfaces I which lead in turn into the outer flank surfaces K.

Figure 3A:
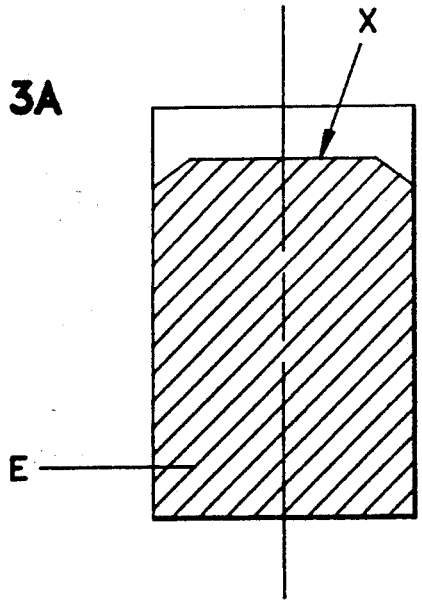
FIG. 3*a* to 3*c* each show a different configuration of the base of the notch.
Figure 3B:
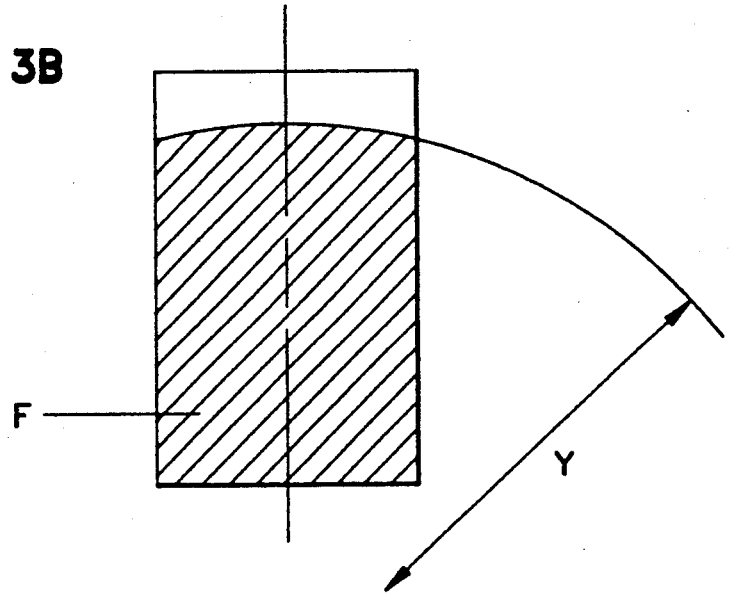
Figure 3C:
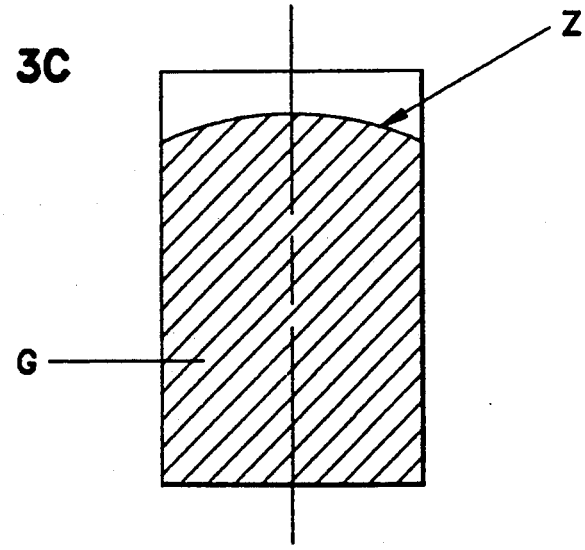

FIGS. 3*a*, 3*b* and 3*c* show three possible land configurations. FIG. 3*a* depicts a tip E with a flat land X of infinite radius. FIG. 3*b* is a tip E with a land of constant radius Y. FIG. 3*c* shows a tip G with a land of changing radii Z.

In typical use a suitable tip is selected and mounted into the holder. FIG. 4 shows how a tip N is configured with a holder M and a drive unit L. The tip is offered against the workpiece edge using the outer flank surfaces of the notch for guidance. FIG. 5*a* illustrates the principle of operation. The tip W impacts against the edge of the workpiece P, bending over any protrusion S encountered. The direction of motion is indicated by the double arrow Q and the stroke length is represented by R. The tip continues to impact until the inner flank surfaces beat the protrusion sufficiently thin that it breaks, tears or is driven off. The tip still continues to impact against the edge until the finish T conforms to the finish provided for by the root curve.

The device is traversed along the edge of the workpiece until the desired finish is obtained. This is done by hand or by machine. Alternatively the device is fixed in position and the workpiece moved across the tip.

What is claimed is:

1. An edge-finishing device suitable for a right-angled edge of a workpiece, comprising a tip for reciprocation against the edge, the tip having a notch with outer flank surfaces which are at an obtuse angle to one another and serve to guide the tip initially onto the workpiece edge, the notch having inner flank surfaces which are at an obtuse angle to one another and serve to beat a burr or other protrusion thin enough to be broken or driven off from the edge and the base of the notch having a curved surface which, in use, determines the finish given to the edge of the workpiece.

2. An edge-finishing device as claimed in claim 1, wherein the base of the notch has a curved surface which, in use, determines the finish given to the edge of the workpiece.

3. A method of finishing a right-angled edge of a workpiece, comprising reciprocating against the edge of a tip of an edge-finishing device, the tip having a notch, the base of the notch having a curved surface which determined the edge finish and flank faces which are at an obtuse angle to one another for guiding the tip onto the workpiece edge, the tip beating a burr or other protrusion on the workpiece edge thin enough that it is broken or driven off the edge, and the base of the notch thereafter impacting against the edge until the finish given to the edge of the workpiece conforms to the curved surface of the base of the notch.

4. A method as claimed in claim 3, wherein the flank faces each comprise an outer flank surface for guiding the tip onto the workpiece edge and an inner flank surface, at least one of the inner flank surfaces beating the burr or other protrusion.

* * * * *